United States Patent [19]

Kneer

[11] 4,441,782

[45] Apr. 10, 1984

[54] LAMPSOCKET MECHANISM

[75] Inventor: Manfred M. Kneer, Icard, N.C.

[73] Assignee: Leviton Manufacturing Company, Inc., Little Neck, N.Y.

[21] Appl. No.: 348,110

[22] Filed: Feb. 11, 1982

[51] Int. Cl.[3] ..... H01R 13/50

[52] U.S. Cl. ..... 339/199 R; 339/178

[58] Field of Search ..... 339/178 L, 180, 182 L, 339/191 L, 199, 176 L, 177 L

[56] References Cited

U.S. PATENT DOCUMENTS

| | | | |
|---|---|---|---|
| 1,389,343 | 8/1921 | Cuthbert et al. | 339/199 C |
| 1,727,148 | 9/1929 | White | 339/199 R |

FOREIGN PATENT DOCUMENTS

| | | | |
|---|---|---|---|
| 228882 | 8/1963 | Austria | 339/178 |
| 930397 | 7/1955 | Fed. Rep. of Germany | 339/199 C |
| 891764 | 3/1962 | United Kingdom | 339/199 R |

*Primary Examiner*—Joseph H. McGlynn
*Assistant Examiner*—David L. Pirlot
*Attorney, Agent, or Firm*—Paul J. Sutton

[57] ABSTRACT

The present invention provides a mechanism for centering the screw base of an incandescent lamp in the socket of a porcelain base having thread segments molded directly onto the inner wall of the socket. A bias contact is provided at the inner wall of the socket for centering the base of the lamp by biasing it in two lateral planes along two planar faces, the pressures from the two faces being perpendicular to the faces and thus directed toward the axis of rotation of the screw base. Thus, the base is continuously centered, so that its center contact makes electrical contact with a centrally located bias contact mounted in a pocket formed in the center of the closed end of the socket. The bias contact and the centrally located contact are in turn connected to electrical leads which extend through the closed end of the socket.

15 Claims, 9 Drawing Figures

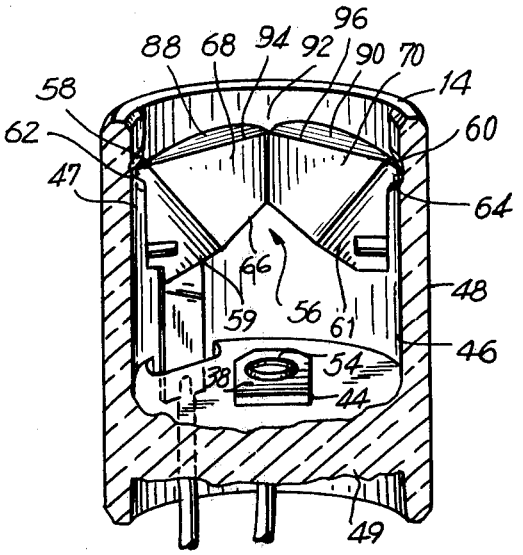
FIG. 7
FIG. 8
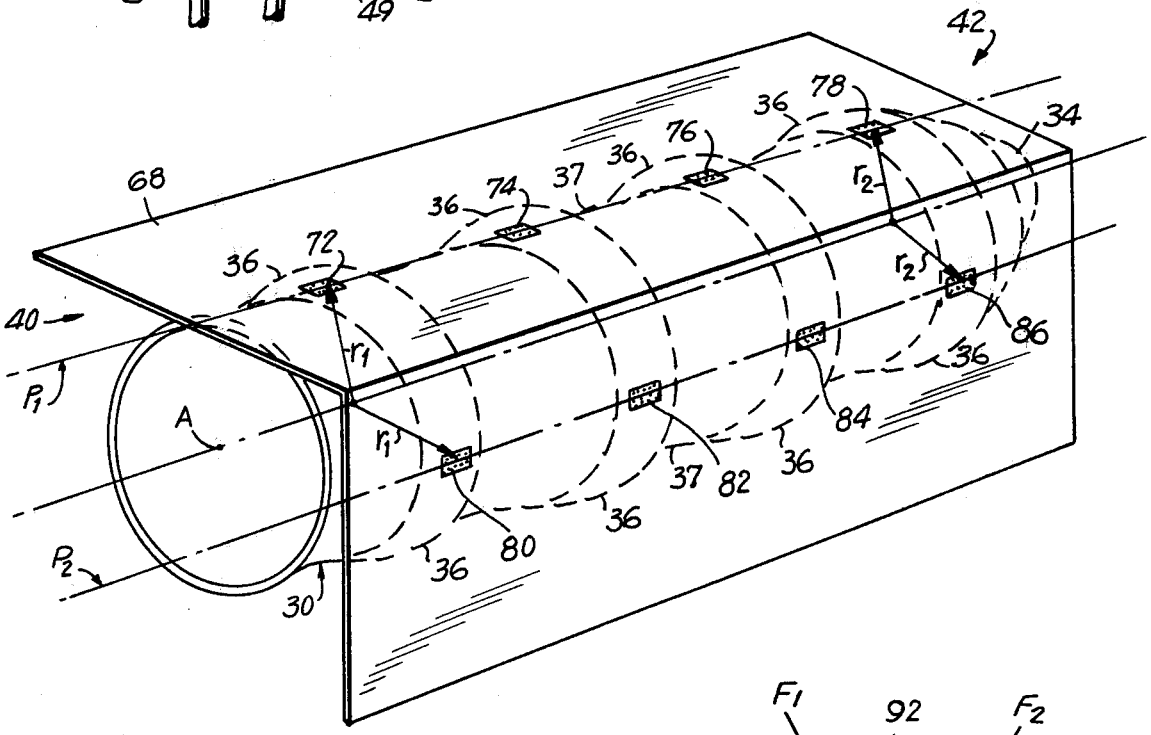
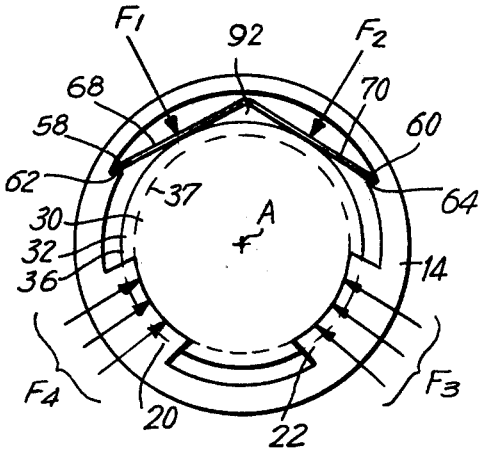
FIG. 9

LAMPSOCKET MECHANISM

The present invention relates generally to a lampsocket mechanism for holding the base of a light bulb, or incandescent lamp, and more particularly to a porcelain lampsocket with molded-in threads for receiving the screw base of an incandescent lamp. The lampsocket of the present invention is generally applicable to any lampsocket but is particularly applicable to a large size socket with American Standard mogul threads known as a mogul socket.

The type of lampsocket in general use utilizes a metal screw shell that is inserted during assembly into the body of the socket and fastened there by various methods using screws, eyelets, rivets, and so on. The screw base of an incandescent lamp is then screwed into the socket. Such a metal screw shell construction calls for obvious detailed complexities in the basic design, manufacture, and assembly of the total lampsocket; the need to manufacture a separate shell, the components to hold the shell in place, and the labor required to actually assemble the socket. Added to this are maintenance costs and spare parts requirements.

There has, therefore, long been a need for a standardized, general purpose lampsocket that eliminates the need for a metal shell insert. The most attractive proposal in the past has been to mold the screw shell thread as an integral part of the body so that the lamp base thread could be received and held by the lampsocket directly. This proposal, however, has been thwarted by the problems created during the baking and drying process of the porcelain, since porcelain shrinks and warps, and bakelite curing varies, beyond the tight tolerances required to maintain continuous electrical connection between the incandescent lamp with the positive and negative leads of the socket. Associated with this problem is the one of designing a mold that will successfully cast threads integral with the porcelain around the interior of the socket that will perform in a manner analogous to the metal screw insert threads of the lampsockets in present use.

A typical lampholder presently in general use has 7–13 components. This model cells for tight tolerances of components, has a considerable material input, and is assembly labor intensive. The limitations and disadvantages of the current lampholders are well-known to those in the industry associated with the art.

My invention contemplates a novel lampholder that reduces or eliminates the above-described limitations and disadvantages of the prior art.

Accordingly, it is an object of my invention to provide in general a lampsocket, that is inexpensive to manufacture and assemble, reliable in operation, and easy to maintain.

Another object of the present invention is to provide a standardized, general purpose lampsocket requiring a minimum number of components, low material intensity, low labor intensity, and loose tolerancing to provide an improved quality product.

A further object of my invention is to provide a lampsocket mechanism with threads integral with the body and that is capable of automatically centering the base of the incandescent lamp in the lampsocket so that the base is in continuous electrical connection with the positive contact of the socket.

Yet another object of my invention is to provide a new lampsocket that uses components of low technical requirements of manufacture.

Yet another object of my invention is to provide a new lampsocket that uses components of low technical requirements of manufacture.

A further object of my invention is to provide a new lampsocket that requires components with a high tolerance span.

Another object of the present invention is to provide a new lampsocket that requires components with simple assembly, maintenance, and spare parts support techniques.

Yet a further object of my invention is to provide a new lampsocket that allows automatic assembly techniques.

A further object of my invention is to provide a lampsocket that allows increased physical separation of the positive and negative connections and leads, thus providing superior electrical performance.

Another object of the present invention is to provide a novel mechanism for a lampsocket that automatically centers the lamp base thus providing a continuous electrical contact between the screw base and the positive electrical contact of the socket and simultaneously creates a continuous electrical contact between the screw base and the negative electrical contact of the socket.

The present invention fulfills the above objects and overcomes limitations and disadvantages of prior art solutions associated with the problems sought to be overcome by prior art by providing a novel mechanism for automatically maintaining a snug fit for the base of a lamp screwed into the socket of a lampholder solely by means of cooperation between internally molded on thread segments of the socket of the body and a bias contact mounted within the socket. The bias contact and the thread segment, or segments, are mounted longitudinally and diagonally opposite one another so that a lateral alignment of the screw base is achieved by way of equal multilateraly forces exerted by the bias contact. The lateral alignment of the screw base thus in turn laterally aligns the screw base, or button electrical contact of the screw base, with one electrical contact area of the socket. In addition, the bias contact simultaneously acts as a second, electrical contact with the base of the bulb. Thus a lampsocket with three basic snap-on components is achieved; the molded body, the center contact, and the bias contact.

My invention will be more clearly understood from the following description of a specific embodiment of the invention together with the accompanying drawings, wherein similar reference characters denote similar elements through the several views, and in which.

Figure 5:
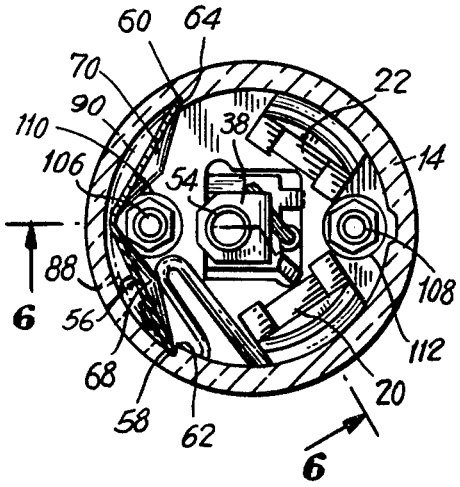
FIG. 5 is a sectional view of the lampsocket taken along the line 5—5 of FIG. 4.
Figure 6:
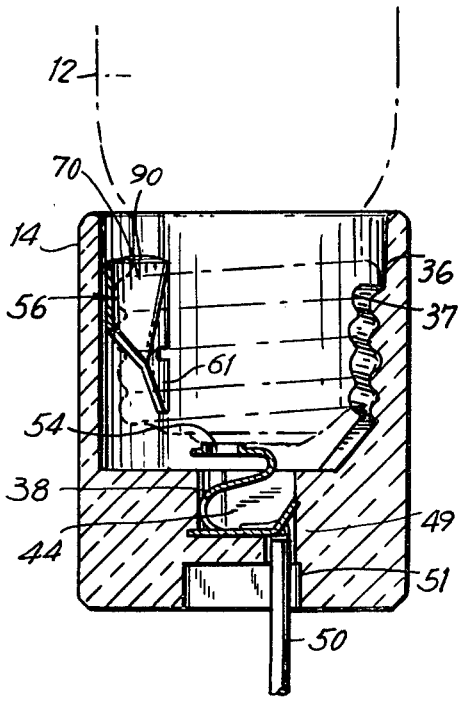

FIG. 6 is a cross-sectional elevation of the lampsocket taken along the line 6—6 of FIG. 5 and shows the screw base of the lamp in bias contact with the bias contact means and the centrally located contact means shown in final mounted position. While not shown in full line, it is contemplated that the center contact when depressed will be situated in the center or concentric with respect to the bulb axis.

FIG. 7 is a fragmentary perspective showing the bias contact means mounted within the lampsocket and the centrally located contact means of the lampsocket.

FIG. 8 is a schematic perspective illustrating the interaction between the planar faces of the bias contact and the threads of the screw base of the incandescent lamp.

FIG. 9 is a schematic cross-section of the lampsocket with lamp screw base showing the interaction of forces between the bias contact means and the thread segment means.

Reference is now made to the drawings and the detailed description of the embodiment illustrated. In the discussion that follows, the common light bulb is referred to by the technical term of art "incandescent lamp" or "lamp."

Figure 1:
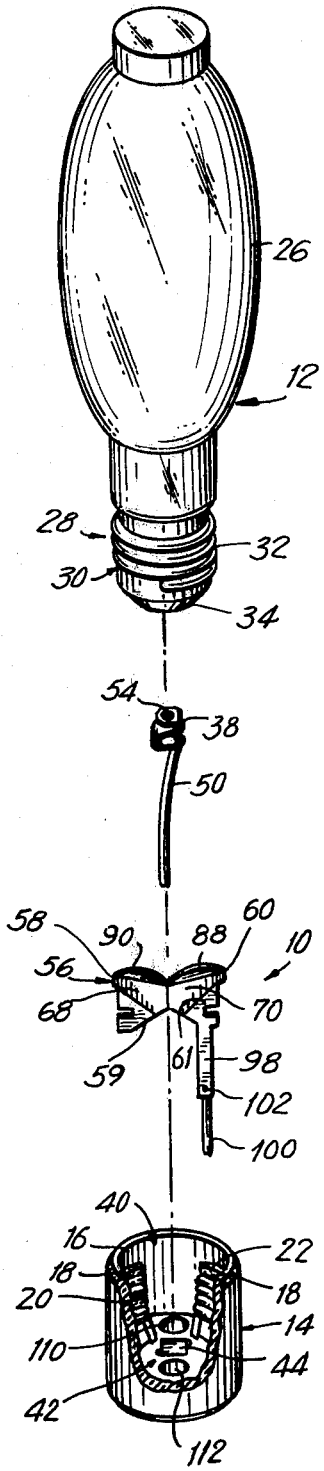
FIG. 1 is a perspective view shown in exploded form and which illustrates the relationship of the lampsocket mechanism with an incandescent lamp and particularly with the screw base of the incandescent lamp.

In FIG. 1 a lampsocket assembly 10 and an incandescent lamp 12 are shown in an exploded illustration with components of the lampsocket assembly and the lamp spaced from one another. A lampsocket body 14 is shown with a portion of the body cut away to illustrate the interior of socket 16 formed by the body and interior construction and arrangement of aspects of the socket. The body may be made of any electrically nonconductive material and may be of any common dimensions. The embodiment specifically described and shown is with American Standard mogul threads, that is, four threads per inch, which are associated with a large porcelain body. Internal thread means 18 are illustrated as separate, first thread segment 20 and second thread segment 22 as the preferred embodiment. Internal thread means 18 may also be one thread segment or three or more separate segments. Segments 20 and 22 are molded solid as a unitary part of porcelain body 14.

Incandescent lamp 12 includes bulb 26 attached to lamp base 28, which includes screw base 30 with metal base threads 32. Socket 16 is capable of receiving base 28; and internal threads 18 and lamp base threads 32 are capable of being received one by the other. Lamp base 28 is further equipped with electrical contact portion 34 located approximately at the center of the screw base. This contact portion, known in the art as the solder, or button, is commonly used as the positive electrical contact point. Outer helical rib 36 of metal screw base 30 acts commonly as the negative electrical base contact surface. (See FIGS. 6 and 8.)

Figure 2:
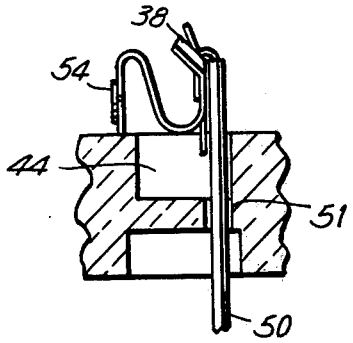
FIG. 2 is a fragmentary sectional elevational view of the centrally located positive contact in position prior to final insertion into the pocket formed in the porcelain body of the lampsocket.
Figure 3:
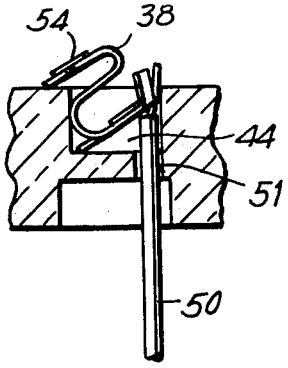
FIG. 3 is a fragmentary sectional elevational view of the positive contact partly inserted in the pocket.

Mounted to porcelain body 14 is centrally located contact means 38, which is made of a resilient, electrically conductive metal. Socket 16 has open end 40, which is capable of receiving lamp screw base 30, and opposed closed end 42. Contact means 38 is mounted within pocket 44, which is formed approximately at the center of closed end 42. The interior of socket 42 is preferably approximately cylindrical in conformation. FIGS. 1 and 2 illustrate contact means 38 as it is assembled and placed into pocket 44. Socket 16, shown in fragmented elevation with inner bottom wall 49, is illustrated along with positive electrical wire lead 50 shown connected to contact 38 at flexible connector 52 (FIG. 1) and positioned in passage 51 formed in closed end 42 of the socket. Center contact 38 is illustrated in its preferable embodiment of an "S" configuration or curve, in sideview, which causes the contact to have an inward bias towards the screw base contact portion, or button. 34. FIG. 2 illustrates the contact positioned prior to insertion into the pocket; and FIG. 3 shows center contact 38 part way into pocket 44. FIG. 6 shows the contact fully inserted into the pocket with direct contact area 54 in electrical contact with button 34 of screw base 30. Contact area, or ring, 54, is positoned beyond inner surface 47 bottom wall 49 of socket 16 in order to achieve full electrical contact with the lamp base, while the inward bias of contact 38 ensures continuous electrical connection.

Lamp 12 is manually screwed into socket 12, and internal thread segment means 18 of socket 16 and base threads 32 of screw base 30 cooperate together, as described previously, and create a longitudinal force of base 28 of the lamp relative to socket 16 that results in pressure contact of contact button 34 into electrical connection with contact area 54 when the lamp is manually screwed into the socket. Centrally located contact 38 and pocket 44 are positioned approximately at the center of closed end 42 of the socket, and direct contact area 54 of contact 38 likewise is positioned approximately at the center of the closed end. Thus, upon manual screwing in of the lamp, button 34 and contact 38 come into pressure contact, and a positive electrical connection is made.

Figure 4:
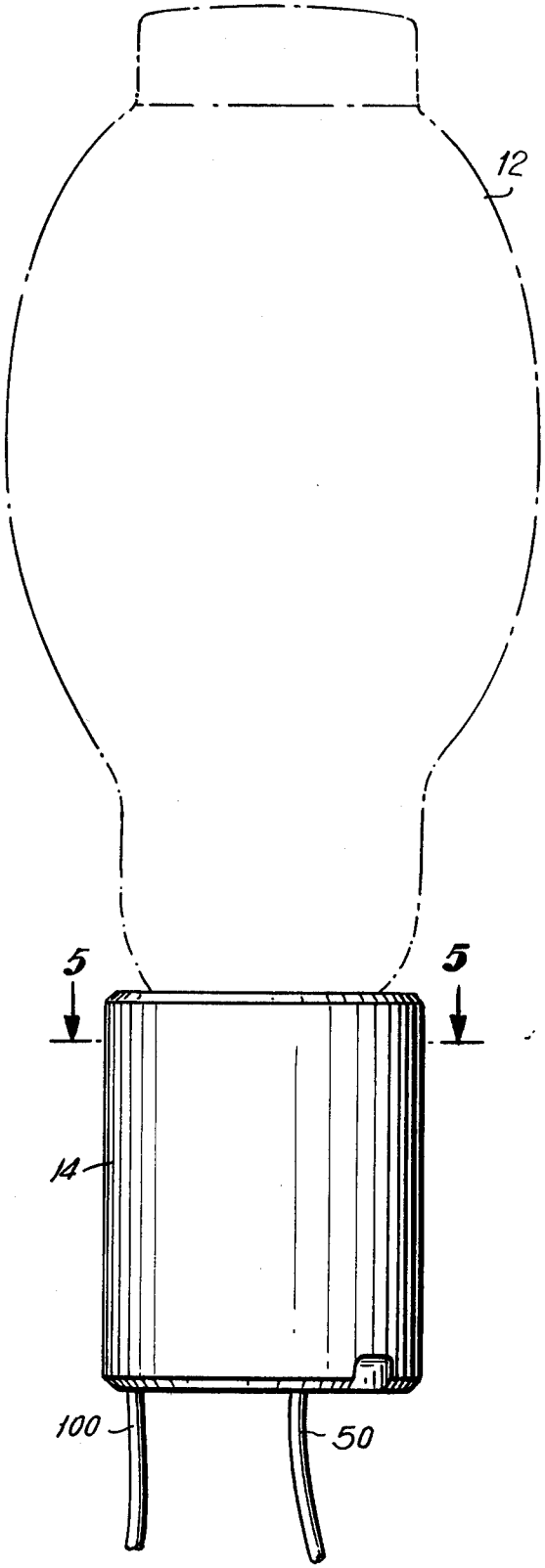
FIG. 4 is an outside elevational view of the incandescent lamp mounted in the socket.

FIG. 1 also illustrates bias contact means 56 as part of the exploded view. FIG. 5 in addition illustrates bias contact 56 in cross-section taken along line 5—5 in FIG. 4, which shows incandescent lamp 12 in its screwed-in position in lamp-socket 16. Bias contact 56, which is made of a resilient, electrically conductive metal, is positioned within socket 16 opposite to thread means 18 in a location to be explained below. Preferably, bias contact 56 has longitudinal tabs 58 and 60 which are snapped, or slid, into position during assembly at longitudinal slots 62 and 64 which are molded in inner wall, or surface, 46 of socket 16, as illustrated in the perspective view of FIG. 7 and in the schematic cross-sectional view of FIG. 9. Tabs 58 and 60, once positioned in slots 62 and 64, hold bias contact 56 captive to porcelain body 14. Also, bias contact 56 is movable toward socket 16 when outward transverse pressure is placed against it and movable inward toward the center of the socket to the extent of its normal position by its resilient bias, with both inner and outer movements made possible by means of the movability of tabs 58 and 60 in slots 62 and 64. FIGS. 5, 6, and particular 7 illustrate contact 56, which includes, besides tabs 58 and 60, resilient member 66 (to which the tabs are attached) which includes first planar face 68 and second planar face 70, which are capable of being in substantially equal longitudinally bias contact with screw base 30.

FIG. 8 shows a schematic perspective of the interaction between planar faces 68 and 70 and threads 32 of screw base 30. Supplementary to this, FIG. 9 shows a schematic cross-section of the interaction between faces 68 and 70 and thread segment means 18, in particular of first and second thread segments 20 and 22 of the preferred embodiment illustrated. For an ideal transmission of bias forces perpendicular to planar faces 68, 70, the faces are to be as smooth as possible to eliminate, or decrease, creation of frictional forces angular to the faces.

Planar faces 68 and 70 are in pressure contact with outer helical rib 36 of screw base threads 32 along a longitudinal plane to be described. Particular areas of contact are exemplified in the schematic perspective of FIG. 8, which indicates screw base 30 in contact with first and second planar faces 68 and 70 of bias contact 56 at various possible pressure areas between outer helical rib 36 of base thread 32.

Base contact portion, or button, 34 is shown indicating the orientation of screw base 30 as related to faces 68 and 70. Incandescent lamp 12 has been screwed into socket 16 and is in pressure contact with bias contact 56. In particular, areas of pressure contact are, indicating from open end 40 of the socket towards closed end 42 of the socket, 72, 74, 76, and 78 between planar face 20 and helical rib 36 and 80, 82, 84, and 86 between planar face 22 and helical rib 36. Planar faces 68 and 70 are at approximately the same planar angles relative to axis of rotation A of screw base 30 and therefore apply approximately equal pressures to base 30 via rib 36 at approximately equal distances from open end 40 or, on the other hand, from open end 42, of the socket. It is noted that because rib 36 is helical, the applied pressures would in theory differ slightly because of the slightly differing distances from the open or closed ends of the socket, but the tolerances of the invention are such that such slightly different resultant pressures are not signficant in the effectiveness of the total mechanism.

Bias contact 56 is preferably positioned within socket 16 with planar faces 68 and 70 placed nearer to inner side wall 47 of socket 16 towards open end 40 than towards closed end 42. FIG. 8 indicates two equal radii $r_i$ from theoretical axis A of the screw base 30 to planar faces 68 and 70 toward open end 40 and two equal radii $r_2$ from A to the faces toward closed end 42, with $r_2$ being greater than $r_1$. Thus, faces 68 and 70 are tilted, or angled, slightly so as to more easily receive screw base 30 without catching or tripping between the threads 32 of the base and open end edges 94 and 96 of faces 68 and 70, respectively. Faces 68 and 70 are positioned within the socket to exert bias pressure at pressure points 72 and 80 towards open end 40 with increasing relative bias pressure towards closed end 42 with the greater relative pressure at bias points 78 and 86. Thus, a wedging action results.

Also, to further aid in the receipt of screw base 30, flaps 88 and 90 are preferably provided at open-end edges 88 and 90 of faces 68 and 70 respectively as illustrated in FIGS. 1, 5 and 7. The flaps tilt outward away from axis A toward the socket side wall or inner surface, 46. FIG. 7 also indicates tab connecting portions 59 and 61 or member 66.

A "V" configuration between faces 68 and 70 is shown since the slight tilt inward of the wedging structure of faces 68 and 70 make a complete mating between them impossible without projection into the socket area.

FIG. 9 schematically shows a cross-section of faces 68 and 70 in pressure contact with outer helical rib 36 of screw thread 32. Axis of rotation A of lamp screw base 30 is also shown in cross-section. The inner portion of the screw rib, 36, is shown as dotted circular line 37. Bias contact 56, which includes slidably mounted tabs 58 and 60, is separated from inner wall 46 of socket 16 by a space 92, which is occupied by bias contact 56 during bias play when lamp base 28 is screwed into position in the socket and presses against faces 68 and 70. Faces 68 and 70 are constructed and arranged in conjunction with thread segment means 18 to receive lamp screw base 30 so that threads 32 of the base are received by threads 24 of the thread means and so that outer helical rib 36 of screw base 30 presses against each of planar faces 68, 70 in bias contact. The cross-section shown in FIG. 9 is taken transverse to the socket and base screw 30 at any of the four pressure point lines of thrust shown on the embodiment transverse to the axis A of the screw base, or socket, formed at 72-80, 74-82, 76-84, or 768-86, as shown in FIG. 8. The bias pressures of the planar faces are according to the laws of mechanics perpendicular to the plane of each planar face 68, 70. That is, radially inward forces $F_1$ and $F_2$ indicated in FIG. 9 act to move screw base 30 toward first and second thread segments 20 and 22 in diametrically opposed directions relative to the segments. Thus, thread segment means 18 is positioned both longitudinally and diametrically opposite to bias faces 68 and 70. Specifically force $F_1$ is met by the approximately diametrically opposed pressures of force $F_3$, which is exerted at the peak and valley of the ribs of second thread segment 22, and force $F_2$ is met by the approximately opposed pressure of force $F_4$, which is exerted at thread segment 20 in the same manner as at the ribs of thread segment 22. The pressures $F_1$, $F_2$, $F_3$, and $F_4$, are exerted approximately on each of the four transverse pressure area planes noted above. FIG. 8 also indicates that two pressure lines of thrust $P_1$ and $P_2$ longitudinal to axis A of the screw base are formed, namely, the first line $P_1$ by pressure areas 72, 74, 76, and 78 between face 68 and screw base 30 and the second line $P_2$ by pressure areas 80, 82, 84, and 86 between face 70 and screw base 30. In fact, the pressure areas are more than points and therefore pressure lines of thrust $P_1$, $P_2$ are only approximately formed. Pressure is exerted on each of these lines transverse to, that is, approximately perpendicular to, the planes of planar faces 68 and 70; that is, transverse bias pressure is applied against screw base 30 on first and second planes perpendicular to the named planar faces. Or, transverse bias pressure is applied against screw base 30 on first and second planes formed approximately on axial planes formed by the named first and second pressure lines $P_1$ and $P_2$ and the axis A of the screw base.

Screw base 30 is pressured over an area of the top of thread rib 36 and the groove between the rib at a varying pressure applied transversely over the thread segments 20 and 22. Pressure is received by the thread segment means 18, as discussed, approximately diametrically from the applied pressures but spread out over a wider contact area between the thread segment means and screw base threads 32.

From the interplay of the bias forces against the screw base of the incandesent lamp, the screw base is kept approximately centered in the lampsocket. Likewise, the electrical contact portion, or bottom, of the screw base is kept substantially centered in the lampsocket and is thus kept in substantial alignment with the centrally located contact of the lampsocket and continuous electrical contact is made.

Bias contact 56 in addition makes electrical contact between metal screw base 30 and the outside power source. This contact is usually the negative contact. The connection is made via extension 98 of member 66 and negative lead wire 100, which is attached to extension 98 by spotweld or quick connect tabs. Extension 100 is illustrated in the preferred embodiment of FIG. 7 as passing through passage 104 formed in porcelain body 14 at the outer periphery, that is, at the inner surface 47, of socket 16. Bias contact 56 is kept in continuous electrical contact with metal screw base 32 by means of the inward bias of the contact, that is, by the same forces that keep screw base 30 in alignment.

It is to be noted that positive wire lead 50 of the invention passes from the center of the closed end of body 14 and negative wire lead 100 passes from the periphery of the closed end. This physical separation of the electrical current carrying members results in superior electrical performance as compared to a conventional socket.

Porcelain body 14 is connected to a support by means of two fastening screws locked with nuts and bolts and indicated as 106 and 108 and shown in FIG. 5. FIG. 1 illustrates screw passages 110 and 112 formed in closed end 42 of socket 16 for receiving fastening screws 106 and 108.

Variations from the embodiment just described fall within the scope of this invention. For example, two planar faces 68 and 70 exert approximately equal bilateral pressures against the screw base threads and thus approximately equal bilateral pressures of the screw base against the thread segments. It is entirely within the scope of the invention to have, for example, three or more planar faces included with bias contact 56 that would exert pressure at a plurality of lateral areas across the screw base against a plurality of areas on the thread segment means rather than two faces described. Also, biasing details for centrally located contact 38 and bias contact 56 other than those described are possible without departing from the spirit of the invention.

The embodiments of the invention particularly disclosed here are presented merely as examples of the invention. Other embodiments, forms, and modifications of three inventions coming within the scope of the appended claims will, of course, readily suggest themselves to those skilled in the art.

What is claimed is:

1. A lampsocket mechanism for holding an incandescent lamp, said lamp being of the type having a screw base having an electrical contact portion approximately at the center of said base, said base being rotatable about an axis of rotation, said mechanism comprising:

an electrically nonconductive body forming a socket capable of receiving said screw base of said lamp, a centrally located contact means mounted on said body for electrically contacting said electrical contact portion of said screw base, thread segment means within said socket unitary with said body for engaging the threads of said screw base, said thread segment means and said screw base cooperating to press said electrical contact portion of said screw base longitudinally against said centrally located contact means when said screw base is manually screwed into said socket, bias contact means mounted within said socket opposed to said thread segment means, said bias contact means being biased inwardly and being in bias contact with said screw base along a plurality of longitudinal lines of thrust when said base is screwed into said socket, said bias contact means being for laterally pressuring against said screw base along a plurality of planes formed by said longitudinal lines with said axis of rotation, whereby the screw base is laterally aligned in the socket and the electrical contact portion of the screw base is centered into alignment with the first contact means, said bias contact means also being for electrically contacting the screw base of said lamp, a first electrical lead connected to said centrally located contact means, and a second electrical lead connected to said bias contact means, said bias contact means including a resilient member having a plurality of planar faces, each face being mounted diametrically and longitudinally opposite to said thread segment means and each face bing capable of exerting equal lateral pressures along said lines of thrust in an axial direction against said screw base.

2. A mechanism according to claim 1, wherein said resilient member has two planar faces.

3. A mechanism according to claim 1, wherein said thread segment means includes a plurality of thread segment portions formed on the inner surface of said socket, each portion including threads for engaging the threads of said screw base, and being positioned to receive said lateral pressures exerted by said planar faces via said biasing means.

4. A mechanism according to claim 1, wherein said resilient member is made of resilient, electrically conductive metal.

5. A mechanism according to claim 1, wherein said base of said lamp is a mogul base and said socket is of a size to accommodate said mogul base.

6. A mechanism according to claim 1, wherein said planar faces are positioned at approximately equal planar angles relative to said axis of rotation.

7. A mechanism according to claim 6, wherein said socket has an open end and an opposed closed end and wherein said planar faces are positioned with their planes at a first radial distance relative to said axis of rotation toward said open end and at a second radial distance relative to said axis toward said closed end, said second radial distance being greater than said first radial distance, whereby the threads of the screw base can pass into the socket without interference.

8. A mechanism according to claim 7, further including protective flap members secured to the edge portions of said planar faces toward said open end, said protective flap members being capable of guiding the threads of the screw base, whereby the threads of the screw base are not caught on the planar members during insertion of the incandescent lamp.

9. A mechanism according to claim 1, wherein said socket forms a plurality of slots on the inner surface of said socket and further including a plurality of mounting tabs secured to said resilient member, said slots being capable of slidably receiving and holding said tabs, said tabs being slidably movable outwardly in said slots in response to bias pressure and inwardly in said slots in response to pressure received from said screw base.

10. A mechanism according to claim 9, wherein said planar faces are spaced away from the inner wall of said socket.

11. A mechanism according to claim 1, wherein said socket has an open end and an opposed closed end, said closed end forming a pocket substantially at the center of said closed end, said pocket being capable of receiving said center contact means and said center contact means is mounted in said pocket.

12. A mechanism according to claim 11, wherein said closed end has an inner surface and said center contact means includes an inwardly biased contact area positioned inwardly beyond said inner end surface, said area being in biased electrical contact with said center contact portion of said screw base when said lamp is screwed into said socket.

13. A mechanism according to claim 12, further including first and second passages for receiving said first and second electrical leads respectively, said first lead being located substantially at the center of said closed end and said second lead being located substantially at the inner side wall of said socket, whereby the first and second leads are spaced apart from one another so that current interference is decreased.

14. A mechanism according to claim 1, wherein said body is made of porcelain.

15. A mechanism according to claim 14, wherein said thread segment means is molded solid with said porcelain body.

* * * * *